US007425964B2

(12) United States Patent
Chen et al.

(10) Patent No.: US 7,425,964 B2
(45) Date of Patent: Sep. 16, 2008

(54) METHOD FOR COMPENSATING COLORS OF A DISPLAY DEVICE

(75) Inventors: Chih-Wei Chen, Yonghe (TW); Shin-Chang Jiang, Taoyuan (TW); Ker-Feng Lin, Taipei (TW)

(73) Assignee: Au Optronics Corp., Hsinchu (TW)

( * ) Notice: Subject to any disclaimer, the term of this patent is extended or adjusted under 35 U.S.C. 154(b) by 652 days.

(21) Appl. No.: 11/181,083

(22) Filed: Jul. 14, 2005

(65) Prior Publication Data

US 2006/0012607 A1 Jan. 19, 2006

(30) Foreign Application Priority Data

Jul. 15, 2004 (TW) ..... 93121118 A

(51) Int. Cl.
*G09G 5/02* (2006.01)

(52) U.S. Cl. ..... 345/590; 345/601

(58) Field of Classification Search ..... 345/590, 345/600–602

See application file for complete search history.

(56) References Cited

U.S. PATENT DOCUMENTS 5,956,044 A * 9/1999 Giorgianni et al. ..... 345/590
2003/0174350 A1* 9/2003 Kim et al. ..... 358/1.9
2004/0196274 A1* 10/2004 Song et al. ..... 345/204

OTHER PUBLICATIONS

Kotera, Hiroaki and Mistunori Suzuki and Hung-Shing Chen. Object-To-Object Color Mapping By Image Segmentation. Journal of Electronic Imaging, Oct. 2001. Headings 4 and 5.5.*

* cited by examiner

*Primary Examiner*—Kee M. Tung
*Assistant Examiner*—Aaron M Richer
(74) *Attorney, Agent, or Firm*—Thomas, Kayden, Horstemeyer & Risley

(57) ABSTRACT

A color compensation method for a display device. A brightness eigenvalue and color gamut eigenvalue of the display device is determined. A plurality of signals of three major colors are applied into the display device to display a plurality of colors. The colors are measured to get a plurality of chromaticity eigenvalues. The brightness eigenvalue, the color gamut eigenvalue and the signals of the three major colors are applied into a formula to establish a color database. A target chromaticity eigenvalue and a data eigenvalue in the color database are applied into another formula to calculate a compensated signal eigenvalue to compensate color difference of the display device.

16 Claims, 3 Drawing Sheets

METHOD FOR COMPENSATING COLORS OF A DISPLAY DEVICE

BACKGROUND

The invention relates to a compensation method, and in particular to a method for compensating colors of a display device.

Liquid crystal displays (LCD) have become widely used, with a working principle based on alignment condition of liquid crystal molecules changing by application of an electrical field so as to change the path of light passing therethrough. Typically, an LCD includes two opposite substrates with a gap therebetween receiving liquid crystal. Both substrates are formed with electrodes to control orientation and arrangement of liquid crystals. Images are displayed on the LCD panel by controlling orientation of liquid crystals with electrical field, in which bright dots or dark dots are generated where the light passes or is blocked.

LCD includes two types. One type is passive matrix and the other active matrix. Each pixel color is determined by current of an end transistor in a row and the start transistor in a column. Passive matrix LCDS provide low cost and small size, however, slow scanning speed and small viewing angle are drawbacks. In active matrix LCDS, each pixel is controlled by a transistor, increasing scanning speed. An active matrix LCD utilizes more than a million transistors and display units, each consisting of three sub display units (R, G, B).

Due to cell light leakage and environment flare, each channel, however, cannot function independently. In addition, channel chromaticity cannot be normalized, due to dispersion and non-consolidation of photo-electronic gamma curves with variations in liquid crystal and wave length.

SUMMARY

An embodiment of the invention provides a color compensation method for a display device, comprising: tuning a red curve, a green curve and a blue curve of a photo-electronic gamma curve of the display device to one curve; determining a brightness eigenvalue and color gamut eigenvalue of the display device from the curve; applying a plurality of signals of three major colors into the display device to display a plurality of colors; measuring the colors to achieve a plurality of chromaticity eigenvalues; applying the brightness eigenvalue, the color gamut eigenvalue and the signals of the three major colors to establish a color database; applying a target chromaticity eigenvalue and a data eigenvalue in the color database to calculate a compensated signal eigenvalue to compensate color difference of the display device; and applying the compensated signal eigenvalue to the display device to generate compensated color.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
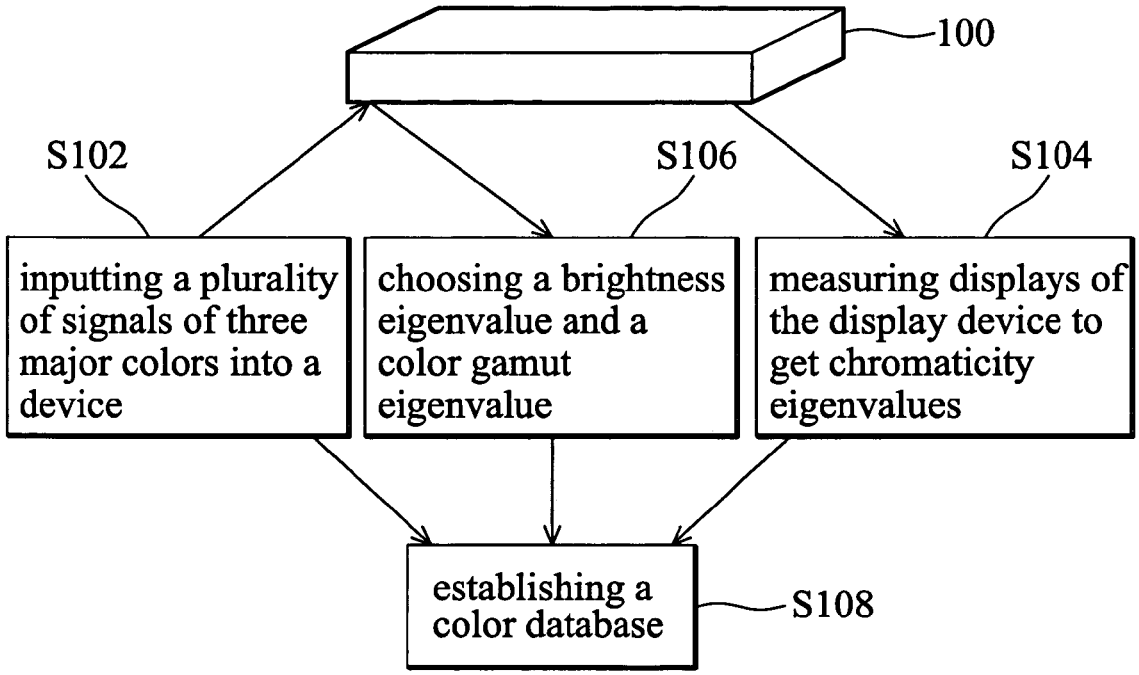
FIG. 1 is a flowchart illustrating a method for establishing a color database of an embodiment of the invention.

FIG. 1 is a flowing chart illustrating a method for establishing a color database of an embodiment of the invention. A plurality of signals of three major colors are applied to a device 100(S102). Displays of the display are measured to achieve a chromaticity eigenvalue S104. Next, a brightness eigenvalue and a color gamut eigenvalue are chosen from the display device S106. A color database is established according to the three color signals, color eigenvalues, brightness eigenvalue and color field eigenvalue S108.

Figure 2:
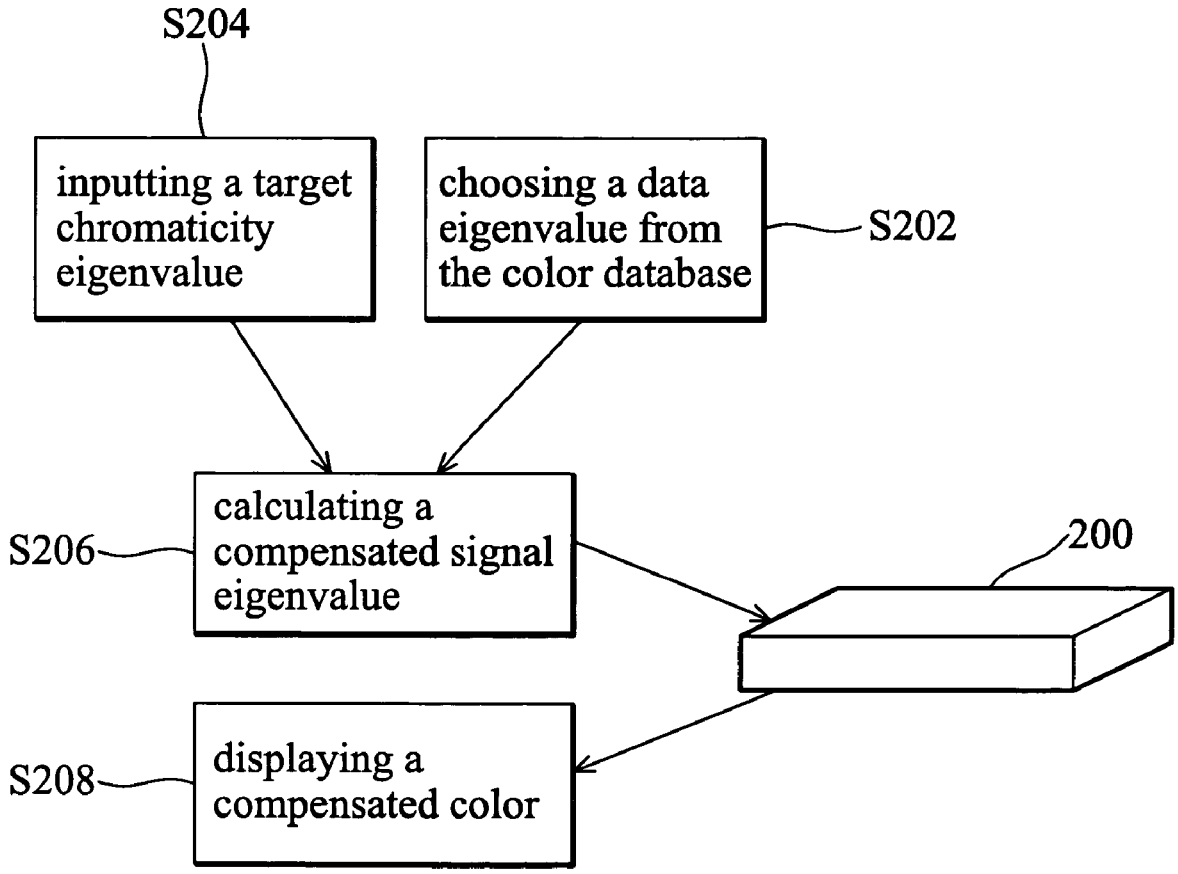
FIG. 2 is a flowchart illustrating a color compensation method for a display device according to the database.

FIG. 2 is a flowchart illustrating a color compensation method for a display device according to the database. As shown in FIG. 2, a data eigenvalue for compensation is chosen from the color database S202. Next, a compensating signal eigenvalue is achieved with matrix calculation S206 and target chromaticity input S204. A compensating signal eigenvalue is applied into a display device to display a compensated color S208.

Figure 3:
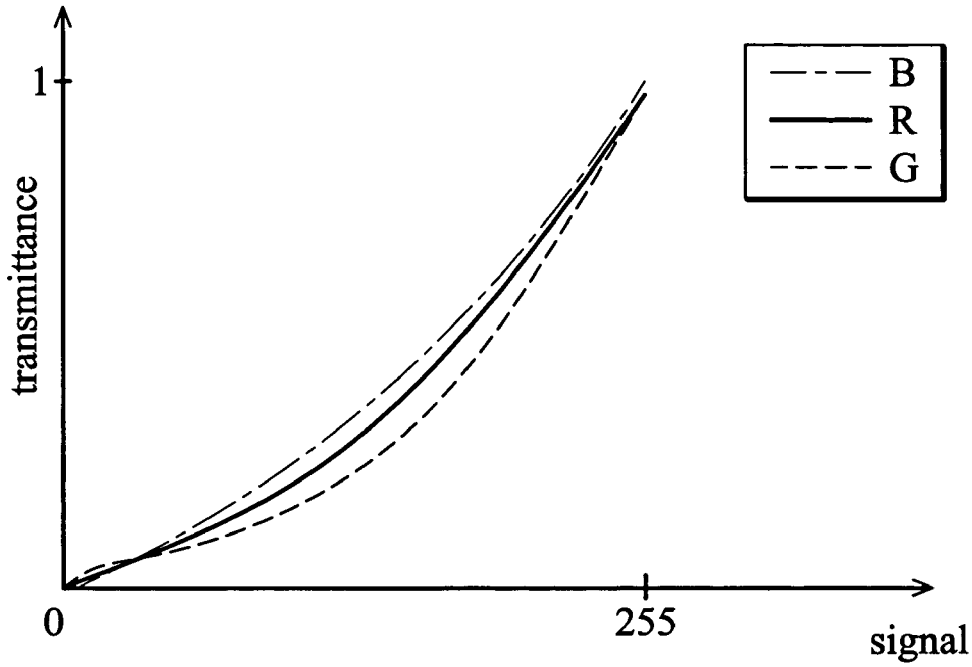
FIG. 3 is a typical gamma curve of a display device of an embodiment of the invention.
Figure 4:
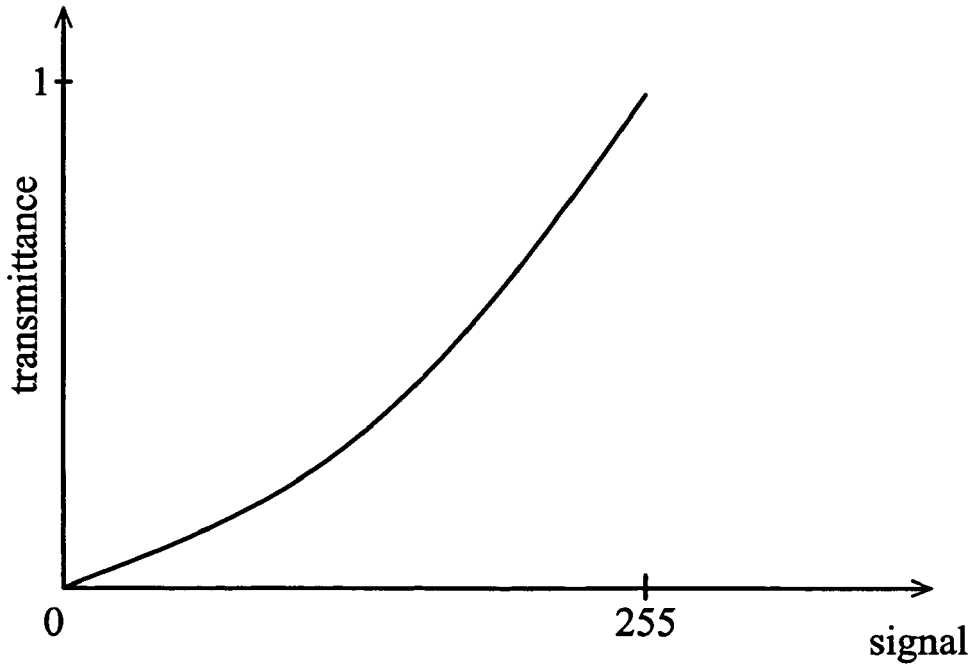
FIG. 4 is a tuned gamma curve of a display device of an embodiment of the invention.

The method for establishing the color database will be described in detail. The step to get the brightness eigenvalue and the color gamut eigenvalue from the display device can be accomplished from the steps below. Typically, the intensities of the three major colors R, G, B are different, and more specifically in LCD. Consequently, three gamma curves are presented, as shown in FIG. 3. In the embodiment, the display device is tuned to achieve a tone response curve (TRC). A brightness eigenvalue and a color gamut eigenvalue are achieved from the TRC.

In the embodiment, the color database is presented as a 3*3 color matrix. The color database, while generated according to the formula below. The invention, however, is not limited thereto.

$$\begin{bmatrix} X \\ Y \\ Z \end{bmatrix} = [S] \times \begin{bmatrix} a_r & 0 & 0 \\ 0 & a_g & 0 \\ 0 & 0 & a_b \end{bmatrix} \times [L] \times \begin{bmatrix} T_r \\ T_g \\ T_b \end{bmatrix}$$

X, Y and Z represent chromaticity eigenvalues measured in the display device. [S] is a matrix of a color gamut eigenvalue, preferably fixed, presented as $$\begin{bmatrix} J_r & J_g & J_b \\ K_r & K_g & K_b \\ L_r & L_g & L_b \end{bmatrix}.$$

$$\begin{bmatrix} a_r & 0 & 0 \\ 0 & a_g & 0 \\ 0 & 0 & a_b \end{bmatrix}$$

is a color database including $a_r$, $a_g$, $a_b$. [L] is also a fixed matrix, presented as $$\begin{bmatrix} L_r & 0 & 0 \\ 0 & L_g & 0 \\ 0 & 0 & L_b \end{bmatrix}.$$

$T_r$, $T_g$, and $T_b$ are respectively normalized signals of three major colors R, G, B, ranging from 0~1. Signals of three major colors ($T_r$, $T_s$, $T_b$) are applied into the display device to achieve a plurality of colors. The colors are measured with an analyzing apparatus, such as spectrum analyzer, to achieve the chromaticity eigenvalue X, Y, Z of each color. Next, Signals of three major colors ($T_r$, $T_g$, $T_b$) and chromaticity eigenvalue X, Y, Z of each color are applied to the formula described.

In the formula described, only the chromaticity vector and the signal vector are variable. The formula can be applied with chromaticity vectors X, Y, Z, and corresponding signal vectors repetitively to calculate a color database.

In a preferred embodiment of the invention, the color database can be divided into three matrixes according three major colors R, G and B. An example of calculating a red color database is described with the following formula.

$$\begin{bmatrix} X \\ Y \\ Z \end{bmatrix} = [S] \times \begin{bmatrix} a_r & 0 & 0 \\ 0 & a_g & 0 \\ 0 & 0 & a_b \end{bmatrix} \times [L] \times \begin{bmatrix} T_r \\ 0 \\ 0 \end{bmatrix}$$

In the formula, only the red color signals, for example $T_r$ are applied, and green and blue color signals are set to zero.

The displayed colors are measured with an analyzing apparatus, such as spectrum analyzer, to get the chromaticity eigenvalue X, Y, Z of each color. Next, signals of red ($T_r$, 0, 0) and chromaticity eigenvalue X, Y, Z of each color are applied to the formula to establish a red color database. Green and blue color databases can also be established simultaneously. Thus, red color, green color and blue color databases are established respectively. The color database can be a combination of red, green and blue database. In addition, establishment of the color database comprises one dimensional LUT (Look-up-Table), three dimensional LUT and multinomial calculation.

In addition, in an embodiment of the invention, measurement of the chromaticity eigenvalue of the display color S104 can further comprise removing noise. The chromaticity eigenvalue measured can be rebuilt with the following formula.

$$\begin{bmatrix} X' \\ Y' \\ Z' \end{bmatrix}_{output} = \begin{bmatrix} X \\ Y \\ Z \end{bmatrix}_{measured} - \begin{bmatrix} X \\ Y \\ Z \end{bmatrix}_{L_0}$$

$$\begin{bmatrix} X \\ Y \\ Z \end{bmatrix}_{measured}$$

is a measured chromaticity vector of a display device.

$$\begin{bmatrix} X \\ Y \\ Z \end{bmatrix}_{L_0}$$

is a measured chromaticity when the R, G and B signals are zero, referring to noise or flare. According to the formula above, the X', Y' and Z' can indicate measured chromaticity vector removed with noise. Accordingly, chromaticity eigenvalues X, Y, and Z can be replaced with X', Y' and Z' when establishing a color database.

A method for compensating colors of a display devices is described with the following formula.

$$\begin{bmatrix} R' \\ G' \\ B' \end{bmatrix} = \begin{bmatrix} a_r & 0 & 0 \\ 0 & a_g & 0 \\ 0 & 0 & a_b \end{bmatrix}^{-1} \times \begin{bmatrix} 1/L_r & 0 & 0 \\ 0 & 1/L_g & 0 \\ 0 & 0 & 1/L_b \end{bmatrix}^{-1} \times [S]^{-1} \times \begin{bmatrix} X_s \\ Y_s \\ Z_s \end{bmatrix}_{target}.$$

$a_r$, $a_g$ and $a_b$ are data signals selected from the color database above. The step of selecting a data comprises one dimensional LUT (Look-up-Table), three dimensional LUT and multinomial calculate.

$$\begin{bmatrix} a_r & 0 & 0 \\ 0 & a_g & 0 \\ 0 & 0 & a_b \end{bmatrix}^{-1}$$

is a reverse matrix of $a_r$, $a_g$ and $a_b$. $L_r$, $L_g$ and $L_b$ are brightness eigenvalue of three major colors.

$$\begin{bmatrix} 1/L_r & 0 & 0 \\ 0 & 1/L_g & 0 \\ 0 & 0 & 1/L_b \end{bmatrix}^{-1}$$

is a reverse matrix of inverse of $L_r$, $L_g$ and $L_b$. S are color gamut eigenvalues, $[S]^{-1}$ is a inverse matrix of S and can refer to $$\begin{bmatrix} J_r & J_g & J_b \\ K_r & K_g & K_b \\ L_r & L_g & L_b \end{bmatrix}^{-1}.$$

$X_s$, $Y_s$ and $Z_s$ are target chromaticity vectors, and $$\begin{bmatrix} X_s \\ Y_s \\ Z_s \end{bmatrix}_{target}$$

is a matrix of $X_s$, $Y_s$ and $Z_s$. R', G' and B' are compensated signal vectors of the display device.

The brightness reverse matrix and the color gamut reverse matrix are fixed. A signal $a_r$, $a_g$ and $a_b$ is chosen from the color database. The signal and the target chromaticity are applied to the described formula to get a compensated color signal according to target chromaticity. The compensated color signal can be applied into the display device to display a compensated color close to the target color.

According to the embodiment of the invention, a color database can be established according to the characteristics of the display device, such as a display panel. Resulting display devices can be compensated with the target chromaticity, for example sRGB, as a standard to diminish the color difference problem.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for compensating colors of a display device, comprising:

determining a brightness eigenvalue and a color gamut eigenvalue of the display device;

applying a plurality of signals of three major colors to the display device so as to display a plurality of colors;

measuring the colors to achieve a plurality of chromaticity eigenvalues;

establishing a color database based on the brightness eigenvalue, the color gamut eigenvalue, and the signals of the three major colors; and calculating a compensated signal eigenvalue to be used to compensate a color difference of the display device in accordance with a target chromaticity eigenvalue and a data eigenvalue selected from the color database.

2. The method as claimed in claim 1, wherein the step of establishing the color database comprises:

using a first formula $$\begin{bmatrix} X \\ Y \\ Z \end{bmatrix} = [S] \times \begin{bmatrix} a_r & 0 & 0 \\ 0 & a_g & 0 \\ 0 & 0 & a_b \end{bmatrix} \times [L] \times \begin{bmatrix} T_r \\ T_g \\ T_b \end{bmatrix}$$

to establish the color database, wherein X, Y and Z are chromaticity eigenvalues measured from the display device, [S] is a constant matrix of a color gamut eigenvalue of the display device, $$\begin{bmatrix} a_r & 0 & 0 \\ 0 & a_g & 0 \\ 0 & 0 & a_b \end{bmatrix}$$

is a color database matrix, [L] is a constant brightness matrix, and $T_r$, $T_g$, and $T_b$ are respectively normalized signals of the three major colors, and wherein the chromaticity eigenvalues X, Y, Z and corresponding signal vectors are applied to calculate the color database.

3. The method as claimed in claim 2, wherein the step of applying a plurality of signals of three major colors to the display device comprises:

applying signal eigenvalues ($T_r$,0,0) to establish a red color database;

applying signal eigenvalues (0,$T_g$,0) to establish a green color database; and applying signal eigenvalues (0,0,$T_b$) to establish a blue color database.

4. The method as claimed in claim 3, wherein the color database comprises the red color database, the green color database and the blue color database, and the color database is established by using a one-dimensional LUT (look-up-table), a three-dimensional LUT and multinomial calculation.

5. The method as claimed in claim 1, further comprising, after the step of measuring the colors:

removing noises of the chromaticity eigenvalues.

6. The method as claimed in claim 1, wherein the step of determining the brightness eigenvalue and the color gamut eigenvalue of the display device comprises:

tuning a red curve, a green curve, and a blue curve of a photoelectronic gamma curve of the display device to achieve a tone response curve, wherein the brightness eigenvalue and color gamut eigenvalue are selected from the tone response curve.

7. The method as claimed in claim 1, wherein the step of applying a target chromaticity eigenvalue and a data eigenvalue in the color database to calculate a compensated signal eigenvalue comprises:

using a second formula $$\begin{bmatrix} R' \\ G' \\ B' \end{bmatrix} = \begin{bmatrix} a_r & 0 & 0 \\ 0 & a_g & 0 \\ 0 & 0 & a_b \end{bmatrix}^{-1} \times \begin{bmatrix} 1/L_r & 0 & 0 \\ 0 & 1/L_g & 0 \\ 0 & 0 & 1/L_b \end{bmatrix}^{-1} \times [S]^{-1} \times \begin{bmatrix} X_s \\ Y_s \\ Z_s \end{bmatrix}_{target}$$

to calculate the compensated signal eigenvalue, wherein $a_r$, $a_g$ and $a_b$ are data selected from the color database, $L_r$, $L_g$ and $L_b$ are constant brightness eigenvalues of three major colors, [S] is a constant color gamut eigenvalue, $X_s$, $Y_s$ and $Z_s$ are target chromaticity, R', G' and B' are compensated signal vectors of the display device, and wherein the data and target chromaticity are applied into the second formula to achieve the compensated color signal according to the target chromaticity eigenvalue.

8. The method as claimed in claim 7, wherein the step of establishing the color database further comprises using a one-dimensional LUT (Look-up-Table), a three-dimensional LUT and multinomial calculation.

9. The method as claimed in claim 1, further comprising applying the compensated signal eigenvalue to the display device so as to display a compensated color.

10. A method for compensating colors of a display device, comprising:

tuning a red curve, a green curve, and a blue curve of a photoelectronic gamma curve of the display device to one curve;

determining a brightness eigenvalue and a color gamut eigenvalue of the display device from the curve;

applying a plurality of signals of three major colors to the display device so as to display a plurality of colors;

measuring the colors to achieve a plurality of chromaticity eigenvalues;

establishing a color database based on the brightness eigenvalue, the color gamut eigenvalue, and the signals of the three major colors;

calculating a compensated signal eigenvalue based on a target chromaticity eigenvalue and a data eigenvalue; and applying the compensated signal eigenvalue to the display device to display a compensated color.

11. The method as claimed in claim 10, wherein the step of establishing the color database comprises:

using a first formula $$\begin{bmatrix} X \\ Y \\ Z \end{bmatrix} = [S] \times \begin{bmatrix} a_r & 0 & 0 \\ 0 & a_g & 0 \\ 0 & 0 & a_b \end{bmatrix} \times [L] \times \begin{bmatrix} T_r \\ T_g \\ T_b \end{bmatrix}$$

to establish the color database, wherein X, Y and Z are the chromaticity eigenvalues measured from the display device, [S] is a constant matrix of a color gamut eigenvalue of the display device, $$\begin{bmatrix} a_r & 0 & 0 \\ 0 & a_g & 0 \\ 0 & 0 & a_b \end{bmatrix}$$

is a color database matrix, [L] is a constant brightness matrix, and $T_r$, $T_g$, and $T_b$ are respectively normalized signals of the three major colors, and wherein the chromaticity eigenvalues X, Y, Z and corresponding signal vectors are applied to the first formula to calculate the color database.

12. The method as claimed in claim 11, wherein the step of applying a plurality of signals of three major colors to the display device comprises:

applying signal eigenvalues ($T_r$,0,0) to establish a red color database;

applying signal eigenvalues (0,$T_g$,0) to establish a green color database; and applying signal eigenvalues (0,0,$T_b$) to establish a blue color database.

13. The method as claimed in claim 12, wherein the color database comprises the red color database, the green color database and the blue color database, and the color database is established by using a one-dimensional LUT (Look-up-Table), a three-dimensional LUT and multinomial calculation.

14. The method as claimed in claim 10, further comprising, after the step of measuring the colors:

removing noise from the chromaticity eigenvalues.

15. The method as claimed in claim 10, wherein the step of applying a target chromaticity eigenvalue and a data eigenvalue to the color database to calculate a compensated signal eigenvalue comprises:

using a second formula $$\begin{bmatrix} R' \\ G' \\ B' \end{bmatrix} = \begin{bmatrix} a_r & 0 & 0 \\ 0 & a_g & 0 \\ 0 & 0 & a_b \end{bmatrix}^{-1} \times \begin{bmatrix} 1/L_r & 0 & 0 \\ 0 & 1/L_g & 0 \\ 0 & 0 & 1/L_b \end{bmatrix}^{-1} \times [S]^{-1} \times \begin{bmatrix} X_s \\ Y_s \\ Z_s \end{bmatrix}_{target}$$

to calculate the compensated signal eigenvalue, wherein $a_r$, $a_g$ and $a_b$ are data selected from the color database, $L_r$, $L_g$ and $L_b$ are constant brightness eigenvalues of three major colors, [S] is a constant color gamut eigenvalue, $X_s$, $Y_s$ and $Z_s$ are target chromaticity, R', G' and B' are compensated signal vectors of the display device, and wherein the data and the target chromaticity are applied into the second formula to achieve the compensated color signal according to the target chromaticity eigenvalue.

16. The method as claimed in claim 15, wherein the step of establishing the color database further comprises using a one-dimensional LUT (Look-up-Table), a three-dimensional LUT and multinomial calculation.

* * * * *